US009914128B2

(12) United States Patent
Hackworth

(10) Patent No.: US 9,914,128 B2
(45) Date of Patent: Mar. 13, 2018

(54) ROTOR FOR A ROCK CRUSHER

(71) Applicant: Metso Minerals, Inc., Helsinki (FI)

(72) Inventor: Clint Hackworth, Huntly (NZ)

(73) Assignee: Metso Minerals, Inc., Helsinki (FI)

( * ) Notice: Subject to any disclaimer, the term of this patent is extended or adjusted under 35 U.S.C. 154(b) by 265 days.

(21) Appl. No.: 14/385,698

(22) PCT Filed: Mar. 25, 2013

(86) PCT No.: PCT/FI2013/050330
§ 371 (c)(1),
(2) Date: Sep. 16, 2014

(87) PCT Pub. No.: WO2013/140047
PCT Pub. Date: Sep. 26, 2013

(65) Prior Publication Data

US 2015/0053805 A1 Feb. 26, 2015

(30) Foreign Application Priority Data

Mar. 23, 2012 (NZ) ..... 598989

(51) Int. Cl.
*B02C 13/00* (2006.01)
*B02C 13/18* (2006.01)
*B02C 13/28* (2006.01)

(52) U.S. Cl.
CPC ..... *B02C 13/1835* (2013.01); *B02C 13/2804* (2013.01); *B02C 2013/2812* (2013.01); *B02C 2210/02* (2013.01)

(58) Field of Classification Search
CPC ..... B02C 18/1835; B02C 18/1807; B02C 18/2804; B02C 18/2812
USPC ..... 241/275, 300
See application file for complete search history.

(56) References Cited

U.S. PATENT DOCUMENTS 1,499,455 A * 7/1924 Hadsel ..... B02C 13/1835 241/275
1,600,986 A * 9/1926 Kranz ..... D21D 1/02 241/299
2,211,504 A * 8/1940 Owen ..... B02C 1/10 241/300

(Continued)

FOREIGN PATENT DOCUMENTS

AU 3200177 6/1979
NZ 217753 2/1989

(Continued)

OTHER PUBLICATIONS

New Zealand Search Report for New Zealand Patent Application No. 598989 dated Mar. 28, 2012.

(Continued)

*Primary Examiner* — Faye Francis
(74) *Attorney, Agent, or Firm* — Andrus Intellectual Property Law, LLP

(57) ABSTRACT

A top wear plate for the rotor of a rock crusher, wherein the rotor includes a rotor body, the rotor body having an upper surface. The top plate includes a lip positioned about and descending vertically from the underside of the outer circumference of the lip wear plate, the lip including a protrusion to engage with a complementary recess on the top surface of the rotor body.

6 Claims, 4 Drawing Sheets

(56) References Cited

U.S. PATENT DOCUMENTS 2,534,302 A * 12/1950 Sennholtz ..... B02C 13/28 241/197
2,828,925 A * 4/1958 Rumpel ..... B02C 1/10 241/217
3,153,512 A * 10/1964 Polzin ..... B02C 1/10 241/219
4,390,136 A 6/1983 Burk
4,650,129 A * 3/1987 Newell ..... B02C 13/28 241/185.5
4,690,341 A * 9/1987 Hise ..... B02C 13/1842 241/275
4,923,131 A * 5/1990 Rossouw ..... B02C 13/1842 241/275
5,080,294 A * 1/1992 Dean ..... B02C 2/005 241/207
5,752,665 A * 5/1998 Wason ..... B02C 17/225 241/183
5,829,698 A * 11/1998 Canada ..... B02C 19/0031 241/275
6,189,821 B1 * 2/2001 James ..... B02C 7/12 241/297
7,300,009 B2 * 11/2007 Dallimore ..... B02C 13/1842 241/275
7,451,944 B2 * 11/2008 Hall ..... B02C 2/005 241/207
8,025,247 B2 * 9/2011 Dallimore ..... B02C 13/1835 241/275
8,042,756 B2 * 10/2011 Dallimore ..... B02C 13/1807 241/275
2006/0011762 A1 * 1/2006 Dallimore ..... B02C 13/1835 241/275

FOREIGN PATENT DOCUMENTS

NZ 297910 5/1998
WO 2005030396 4/2005

OTHER PUBLICATIONS

International Search Report and Written Opinion for PCT/FI2013/050330 dated Jul. 16, 2013.

* cited by examiner

ROTOR FOR A ROCK CRUSHER

CROSS-REFERENCE TO RELATED APPLICATIONS

This application is the U.S. national stage application of International Application PCT/NO2013/050330, filed Mar. 25, 2012. which international application was published on Sep. 26, 2013, as International Publication WO2013/140047 in the English language. The international application is incorporated herein by reference, in entirety. The international application claims priority to New Zealand. Patent Application No. 598989, which is incorporated herein by reference.

TECHNICAL FIELD

The present invention relates to a rotor housing to for a rock crusher. The invention has particular application to the top plate of a rotor body for a vertical shaft impact rock crusher.

BACKGROUND ART

A Vertical Shaft Impact (VSI) crusher is a particular type of crusher that is used in the production of aggregate.

A VSI crusher includes a rotor configured to rotate within a crushing chamber at high speeds about a vertical axis. Rock material enters the rotor by an inlet port and, as the rotor spins, is ejected from the rotor via outlet ports arranged about the circumference of the rotor and is hurled against anvils placed strategically about the chamber or the rock lined shell of the crusher chamber.

The impact forces breaks down the ejected rock material into aggregate. A crusher which uses this mode of breaking down rock material is sometimes known as a "rock on rock" crusher.

Some VSI crushers create impact forces by ejecting rock material from the rotor into a cascade of rock material that falls past the outlet ports of the rotor. An example of such a crusher is described in New Zealand Patent No. 297910.

Regardless of the mode of action of the rock crusher, the rotor body and its constituent components are exposed to considerable wear and tear due to the impact of the rock material entering the rotor, and the speeds at which the rotor operates.

A conventional VSI rotor consists of a one piece steel fabricated rotor body. The body includes an inlet port, outlet ports, top plate and a base plate. The various outlet ports are formed by bolting or welding vertical members to the base plate. The rotor body is then protected by a number of wear resistant castings fixed about the rotor using a variety of methods.

To protect the top and base plates of the rotor body, top and bottom wear plates are used. The top wear plate sits over the top plate of the rotor body while the rotor body itself sits atop of the bottom wear plate.

One particular problem that affects the rotor body when it is rotating within the crushing chamber is that the perimeters of the top and base plates experience streaming wear. Fine particle streaming wear can quickly undermine the integrity of the rotor. Once the rotor begins to wear, the rate of wear accelerates. This will often require expensive repairs or replacement of the rotor.

One conventional technique used to protect the perimeters of the top and base plates is to apply a hard facing weld material to the top and bottom wear plates. Another technique is to implement hard metal rollings to the wear plates.

While these techniques do offer some protection to the perimeters of the rotor, this does not fully address the issue of fine streaming wear on the periphery of the rotor itself. Over time, the top and bottom wear plates of the rotor become worn down and will eventually require replacement.

In order to achieve the necessary maintenance and replacement of the various components of the crusher, it must be shut down. VSI crushers are significant items of machinery, processing large amounts of rock material. The rotor body is engineered accordingly.

Furthermore, the running costs of such VSI crushers can be particularly significant. Because of the expenditure associated with the purchase of crushers, and their running costs, operators tend to maximise the use of their crushers where possible.

Thus, it is undesirable to have a VSI crusher offline for extended periods of time in order to fulfill maintenance requirements such as replacing the rotor body of a crusher. The downtime of a crusher can have an impact on the throughput of the facility in which the crusher is installed. If the VSI crusher does need to be offline, then the downtime should be preferably kept to a minimum.

VSI crushers are also used in mineral material processing plants, such as mobile crushing plants, which combine the crusher with a feeding device, such as a conveyor or hopper, on a heavy vehicle. When replacing wear parts on these crushers, not only does the rotor body of the crusher have to partially disassembled but it is often necessary to remove the surrounding ancillary equipment as well. This extends the overall time required to replace the wear part.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DISCLOSURE OF THE INVENTION

According to one aspect of the present invention there is provided a rotor body for a rock crusher, the upper surface of the rotor body configured to engage with a top wear plate, wherein the top wear plate includes a lip positioned about and descending vertically from the underside of the outer circumference of the wear plate, wherein the lip includes a protrusion, the rotor body characterised in that the upper surface includes a recess complementary to the protrusion of the lip of the top wear plate.

According to another aspect of the present invention there is provided a top wear plate for the rotor of a rock crusher, wherein the rotor includes a rotor body, the rotor body having an upper surface, the top wear plate characterised in that it includes a lip positioned about and descending vertically from the underside of the outer circumference of the wear plate, the lip including a protrusion to engage with a complementary recess on the upper surface of the rotor body.

According to another aspect of the present invention there is provided a rock crusher, wherein the rock crusher includes a rotor substantially as described above.

According to yet another aspect of the present invention there is provided a mineral material processing plant, wherein the plant includes a rock crusher including a rotor substantially as described above.

The present invention provides an improved rotor of a rock crusher, and in particular, an improved top wear plate.

The invention has particular application to a type of rock crusher known as the vertical shaft crusher (VSI), although it will be appreciated by a person skilled in the art that the invention may be used in other types of rock crushers, such as a horizontal shaft impact crusher.

A VSI crusher has a rotor which spins at high speed within a crushing chamber.

The rotor body should be understood to mean the part of the rotor which rotates at high speed and includes at least one inlet port for rock material to enter the rotor and at least one outlet port through which the rock material is ejected.

To assist with the breakdown of rock material entering the rotor body, and to help protect the rotor body itself from impact damage, the rotor body is "dressed" with a number of sacrificial wear parts.

The rotor body includes a top plate and a base plate which sandwich the vertically standing walls of the rotor body. These vertical walls define the outlet ports of the rotor body and bear wear parts in the form of rotor tips.

The top plate, which can be thought of as the upper surface of the rotor body, and the base plate also requires protection from impact forces of the rock material, particular as the rotor body rotates in the crushing chamber of the crusher. Top and bottom wear plates are used for this purpose.

The top wear plate should be understood to mean a disc like object which overlays the top plate of the rotor body. The top wear plate includes an aperture at its centre, the aperture corresponding to the inlet port of the rotor body. Thus the top wear plate has an inner circumference defined by the aperture and an outer circumference defined by the outer edge of the top wear plate.

A bottom wear plate should be understood to mean a disc like object which is secured to the underside of the base plate of the rotor body. In some embodiments, the bottom wear plate may include an aperture at its centre. This provides a recess through which a hub or boss may pass, and this assists with securing of the rotor to the shaft of the crusher.

The top wear plate includes a rim or lip about its outer circumference.

In preferred embodiments of the present invention, the rim descends vertically from the underside of the outer circumference of the top wear plate. This effectively forms a recess on the underside of the top wear plate, which is substantially complementary to the dimensions of the top plate of the rotor body.

It will be appreciated that when the top wear plate is placed over the top plate of the rotor body, the rim overlaps and covers the outer edges of the top plate. However, engineering and manufacturing constraints means that there may be a small gap between the rim and the outer edge of the top plate of the rotor body.

Arranged about the interior of the rim of the top wear plate is a plurality of protrusions. These protrusions engage with complementary recesses about the outer edge of the top plate of the rotor body.

The number of protrusions may vary depending upon the requirements of the user, but in preferred embodiments of the present invention at least three protrusions are provided equidistance from each other. However, this is not meant to be limiting, and depending on the requirements of the user more (or less) protrusions may be used. For example, four protrusions may be provided equidistance from each other.

The protrusions may take a variety of forms, but in preferred embodiments of the invention, the edges or sides of the protrusion which arise from the rim of the top wear plate are at a sloping angle relative to the rim.

As rock particles and detritus collects and accelerate between the small gap between the rim and the outer edge of the top plate of the rotor body, they meet with the angled edges of the protrusions. This helps gradually decelerate their velocity, rather than the abrupt halt that may be experienced if the sides of the protrusion were at substantially right angles to the rim.

As discussed above, the rotor body includes a top plate. The top plate is substantially flat, and is substantially complementary to the under surface of the top wear plate.

In particular, the top surface of the rotor body includes a plurality of recesses which are complementary to the protrusions of the top plate. In preferred embodiments of the present invention, the number of recess corresponds with the number of protrusions, but in some embodiments of the present invention there may be more recesses, to allow top wear plates with varying configurations for its protrusions to be used if necessary.

Thus, the top wear plate and the rotor body interlock with each other, preventing the movement of the top wear plate relative to the rotor body. It also acts to disrupt the air flow between the rim and the outer edge of the top plate which can carry abrasive dust particles that wear down the edges. Furthermore, the impact of any dust particles is largely against the protrusions of the sacrificial wear part, rather than the rotor body itself.

Reference has been made in this specification to the invention being used with the top plate of the rotor body. However, this is not meant to be limiting, and persons skilled in the art will readily appreciate that the same principles may be applied to the bottom plate of the rotor.

It will also be appreciated that the configuration of the interlocking components of the top wear plate and rotor body can be rearranged such that the rotor body includes protrusions which engage with recesses about the rim of the top plate.

However, this will require careful consideration during manufacture of the top wear plate to ensure its structural integrity is not compromised. Furthermore, it will be appreciated that this means that the rotor body may experience wear from abrasive dust particles contacting the protrusions of the rotor body.

The crusher incorporating the present invention may be used as a stand alone crusher or alternatively, may be incorporated into a stationary or mobile mineral material processing plant. A mobile mineral processing plant should be understood to mean a heavy vehicle to which a crusher and ancillary equipment such as feed and discharge conveyors may be mounted.

The present invention offers a number of advantages over the prior art, including:

- the respective components of the top wear plate and rotor body may experience less wear than in the prior art;
- high wear areas on the rotor body top and base plates can be transferred to the top and bottom wear plates, thus reducing the potential for wear on the rotor body itself;
- maintenance costs and time offline for the crusher utilising the present invention are reduced or otherwise minimised;
- furthermore, it facilitates easy maintenance of the rotor body if required;
- at the very least, the present invention offers the public the use of choice.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
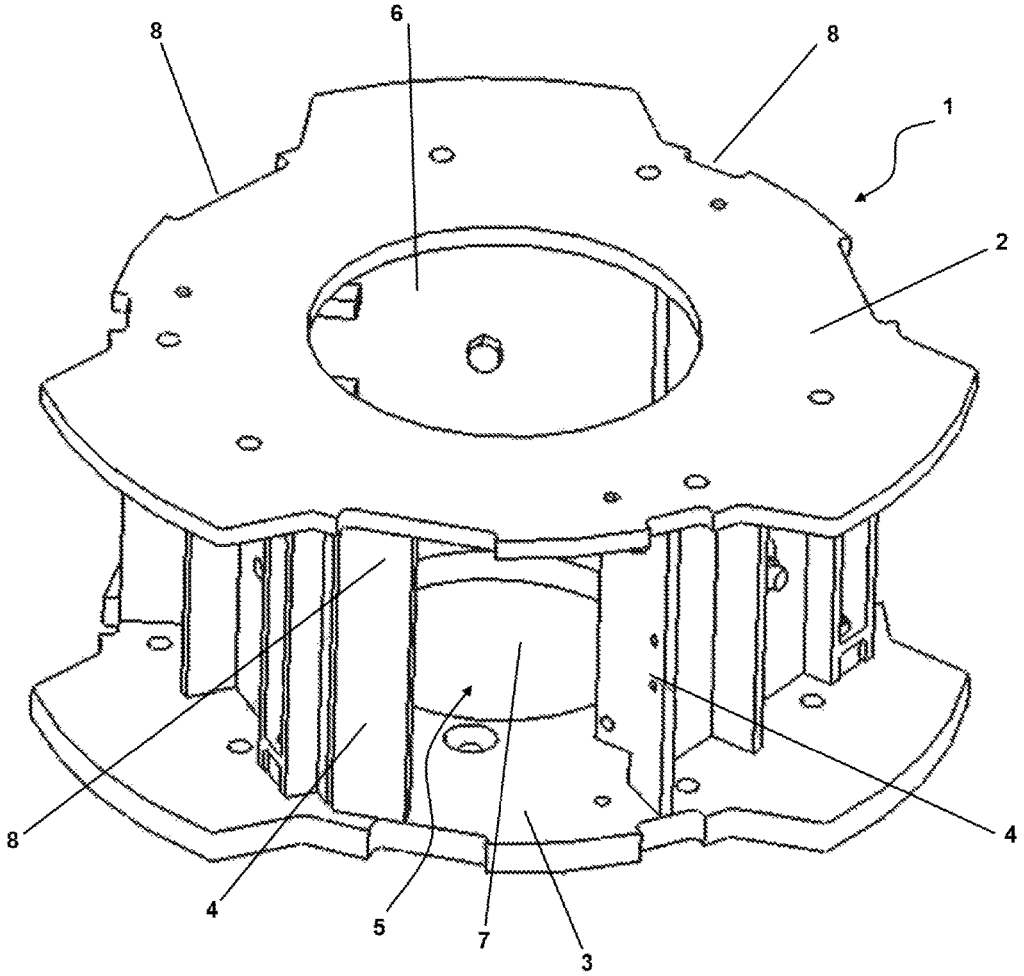
FIG. 1 is a perspective view of a rotor body.

The rotor body (generally indicated by arrow 1) of the present invention is depicted in FIG. 1.

In use, the rotor body (1) would be "dressed" with various wear parts (not shown), but here it is an "undressed" state.

The rotor body (1) includes a top (2) plate and base (3) plate. These sandwich vertically standing walls (4), which define the outlet ports (5) and would bear wear parts (not shown) when the rotor is "dressed".

At the centre of the top (2) and base (3) plates are circular apertures (6, 7). The aperture (6) in the top plate (2) defines the inlet port, by which rock material (not shown) enters the rotor body (1) in use. In use, the aperture (7) in the base plate (3) supports a hub or boss to facilitate installation onto the crusher shaft (not shown)

It will be appreciated that arranged equidistance around the perimeter of both the top (2) and base (3) plates of the rotor body (1) are a plurality of recesses (8).

Figure 2:
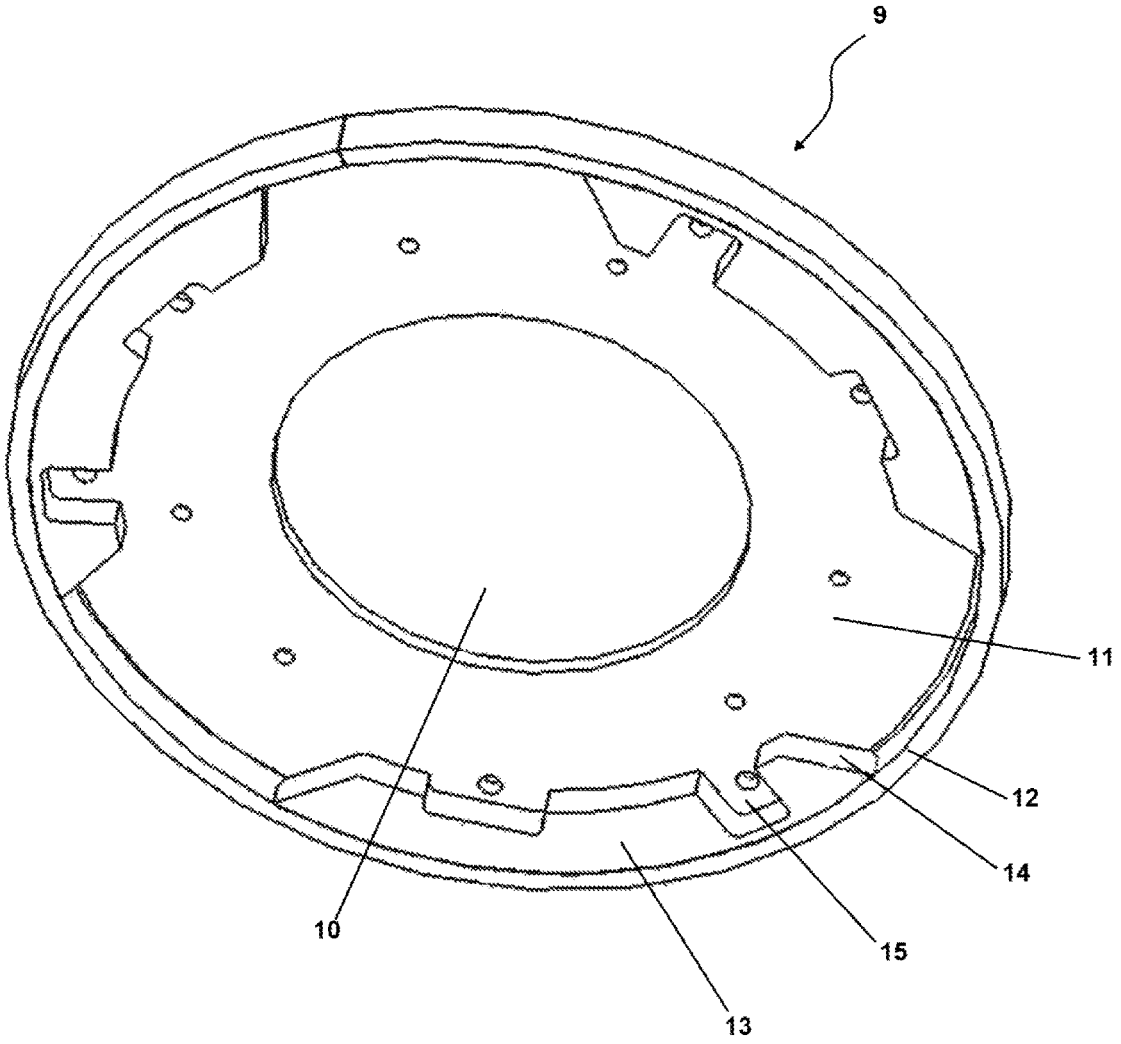
FIG. 2 is a perspective view of the top plate of the present invention.

These recesses (8) engage with the top wear plate (9) of the present invention, which is illustrated in FIG. 2.

The top wear plate (9) includes an inlet port (10), which in some embodiments may include a rim (not shown) about the perimeter of its underside (11). The rim (not shown) would engage with the inlet port of the rotor body (not shown), and provide some protection for the top plate (not shown) of the rotor body.

The top wear plate (9) is provided with a rim (12) descending from its outer perimeter.

Arranged equidistance around the perimeter of the rim (12) is a series of protrusions (13) extending towards the inlet port (10). The sides (14) of these protrusions (13) are angled such that the sides (14) of the protrusions (13) at not substantially at right angles to the rim (12)

In use, these protrusions (13) engage with the recesses (not shown) of the rotor body (not shown), effectively locking it relative to the rotor body. The protrusions also act to disrupt or otherwise minimise airflow between the perimeter of the rotor body (not shown) and the top wear plate (9).

The protrusions of the top wear plate may include additional recesses (15) to help 'key' in with complementary protrusions on the rotor body (not shown) or to provide locations for additional wear parts to be fitted to the rotor.

Figure 3:
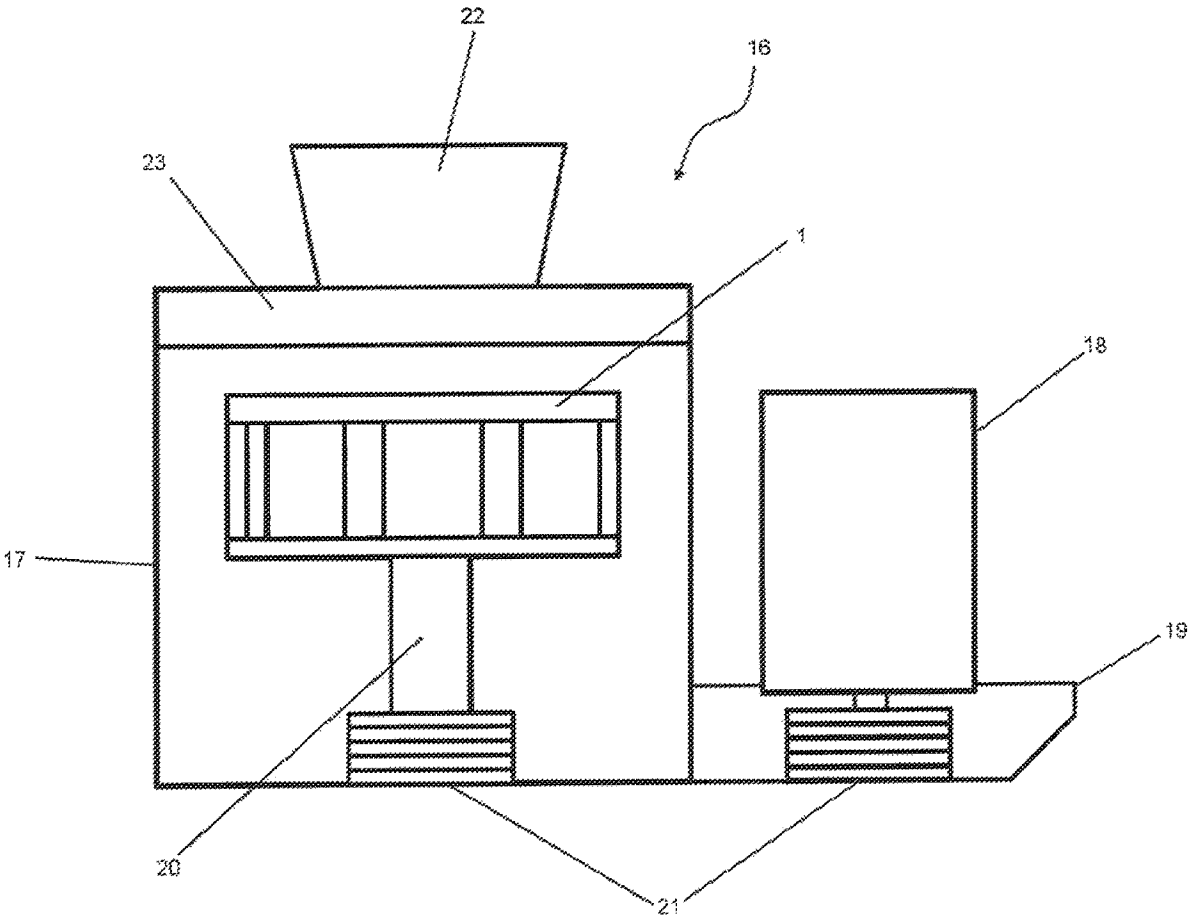
FIG. 3 is a side view of a crusher including the rotor body of the present invention.

Turning now to FIG. 3, this depicts a crusher (16) which includes the rotor body (1) housed within a frame (17). The crusher (16) is driven by a motor (18) mounted to a frame (19). Both the motor (18) and the rotor shaft (20) are provided with pulleys (21).

Rock material (not shown) enters the crusher (16) via a feeder hopper (22) mounted to the roof (23) of the crusher (16).

Figure 4:
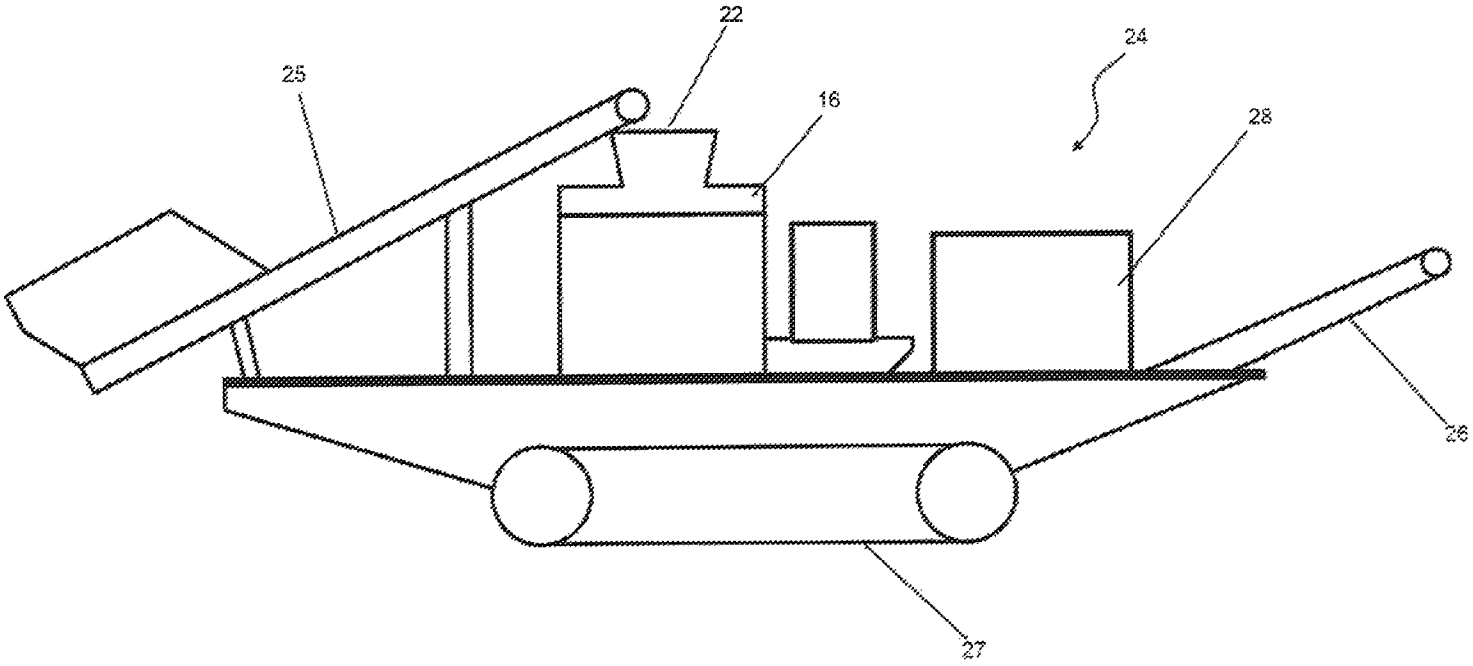
FIG. 4 is a side view of a mobile mineral material processing plant.

FIG. 4 shows the crusher (16) as part of a mobile mineral material processing plant (24).

The plant (24) includes a feeding device (25) to conduct rock material (not shown) to the feeder hopper (22) of the crusher (16). As the rock material is processed, it exits the plant (24) via a discharge conveyor (26).

The plant (24), mounted to a tracked propelling means (27), is operable via a control unit (28) which controls the crusher (16) and its ancillary equipment such as the feeding device (25). It should be appreciated that instead of, or in addition to, tracks the plant (24) may include wheels, runners or legs.

Aspects of the present invention have been described by way of example only and it should be appreciated that modifications and additions may be made thereto without departing from the scope thereof.

I claim:

1. A wear plate for use on a rotor of a rock crusher, the rotor having a rotor body including a planar surface including at least one recess, the wear plate comprising:

- a circular aperture located at a center of the wear plate;
- a planar underside surrounding the circular aperture and defined by an outer perimeter;
- a rim positioned about the outer perimeter and descending perpendicular to the planar underside; and
- at least one protrusion extending perpendicular to the rim and toward the circular aperture, the at least one protrusion including an edge or side extending at a sloping angle relative to the rim.

2. A wear plate as claimed in claim 1, wherein the wear plate includes at least three protrusions.

3. A wear plate as claimed in claim 2, wherein the protrusions are equidistance from each other.

4. A rotor assembly for use in a rock crusher, comprising:

- a rotor body having an upper surface and a lower surface; and
- a pair of wear plates each having a circular aperture, a planar underside defined by an outer circumference and a rim positioned about the outer circumference and descending perpendicular to the planar underside, the wear plates each including at least one protrusion extending from the rim and having an edge or side that is at a sloping angle relative to the rim,
- wherein the upper and lower surface of the rotor body each include at least one recess complementary to the at least one protrusion extending from the rim of each wear plates in the pair of wear plates, wherein the at least one protrusion is configured to engage the at least one recess.

5. A rock crusher, including the rotor of claim 4.

6. A mineral material processing plant, wherein the mineral material processing plant includes the rock crusher of claim 5.

* * * * *